US009153397B2

(12) United States Patent
Lacey et al.

(10) Patent No.: US 9,153,397 B2
(45) Date of Patent: Oct. 6, 2015

(54) WIRING DEVICE WITH METAL SWITCH COVER

(71) Applicants: Darron Lacey, Fayetteville, GA (US); Rahul Natwar Goyal, Tyrone, GA (US); Rohit Sumerchand Dodal, Peachtree City, GA (US); Luis F. Salas, Fayetteville, GA (US); Carlos Eduardo Restrepo, Atlanta, GA (US); Erik Gouhl, Fayetteville, GA (US)

(72) Inventors: Darron Lacey, Fayetteville, GA (US); Rahul Natwar Goyal, Tyrone, GA (US); Rohit Sumerchand Dodal, Peachtree City, GA (US); Luis F. Salas, Fayetteville, GA (US); Carlos Eduardo Restrepo, Atlanta, GA (US); Erik Gouhl, Fayetteville, GA (US)

(73) Assignee: Cooper Technologies Company, Houston, TX (US)

( * ) Notice: Subject to any disclaimer, the term of this patent is extended or adjusted under 35 U.S.C. 154(b) by 300 days.

(21) Appl. No.: 13/711,035

(22) Filed: Dec. 11, 2012

(65) Prior Publication Data

US 2014/0158510 A1 Jun. 12, 2014

(51) Int. Cl.
*H01H 23/14* (2006.01)
*H01H 21/22* (2006.01)

(52) U.S. Cl.
CPC ..... *H01H 21/22* (2013.01); *H01H 23/145* (2013.01); *Y10T 29/49105* (2015.01)

(58) Field of Classification Search
CPC ..... H01H 13/183; H01H 13/18; H01H 3/16; H05K 5/03; H05K 5/04
USPC ..... 200/330, 331, 339
See application file for complete search history.

(56) References Cited

U.S. PATENT DOCUMENTS

| | | | | |
|---|---|---|---|---|
| 3,621,164 | A * | 11/1971 | Backer | 200/61.58 R |
| 4,313,041 | A * | 1/1982 | Ohashi | 200/6 R |
| 4,482,792 | A * | 11/1984 | Geremia | 200/302.3 |
| 4,767,895 | A * | 8/1988 | Parrish | 200/43.04 |
| 2008/0296136 | A1 * | 12/2008 | Kelso et al. | 200/330 |
| 2010/0150979 | A1 * | 6/2010 | Lacey et al. | 424/411 |

* cited by examiner

*Primary Examiner* — Amy Cohen Johnson
*Assistant Examiner* — Marina Fishman
(74) *Attorney, Agent, or Firm* — King & Spalding LLP

(57) ABSTRACT

An electrical wiring device includes a metal switch cover as a user contact point. The metal switch cover has antimicrobial properties that reduces microorganisms that are present on the wiring device, and helps reduce the spread of infections or disease from user to user. The metal switch cover is disposed on a switch in the wiring device, such that users touch the metal switch cover when operating the switch. In some exemplary embodiments, the metal switch cover is coupled to a paddle-style switch and takes on the profile of a paddle. In some exemplary embodiments, the metal switch cover is coupled to a toggle-style switch and take on the profile of a toggle.

13 Claims, 5 Drawing Sheets

WIRING DEVICE WITH METAL SWITCH COVER

TECHNICAL FIELD

The present invention relates generally to the field of wiring devices. More specifically, the present invention relates to a wiring device having a metal switch cover.

BACKGROUND

Wiring devices are commonly present in industrial, commercial, and residential areas. As used herein, the term "wiring device" refers to faceplates, wallplates, coverplates, telephone plates, touch pads, dimmer slides, switches, circuit units, plugs, connectors, receptacles, and other similar devices, and may be current-carrying or noncurrent-carrying.

Wiring devices, such as switches, are generally touched by a number of people during normal daily traffic. As a result, the wiring devices are exposed to a number of microorganisms, such as bacteria and fungi, that may be carried by each person. In addition, some microorganisms can be airbourne and deposited onto the wiring devices. These microorganisms can be transferred from one user to another and result in the contraction of an infection or a disease. For instance, a nurse tending to a patient in a hospital room contacts a light switch in the room prior to washing his/her hands, thus exposing the light switch to one or more microorganisms. When the next person enters the room and he/she contacts the light switch, he/she will be exposed to the microorganisms present on the switch. As a result of the exposure, the person's contact could result in an infection or a disease.

Currently, wiring devices can be coated with a spray, such as a household cleaner, containing antimicrobial properties. The drawback to using sprays having antimicrobial properties is that they wear off over time and thus lose efficacy.

SUMMARY

An exemplary embodiment of the present invention includes an electrical wiring device. The electrical wiring device includes a housing forming a cavity therein, a paddle assembly disposed at least partially within the cavity. The paddle assembly includes a paddle base having a first side and a second side. A portion of the paddle base is pivotally coupled to the housing within the cavity via the second side. The paddle assembly also includes a metal member coupled to the paddle base and disposed substantially on the first side of the paddle base. The paddle assembly is pivotally movable between a first position and a second position.

Another exemplary embodiment of the present invention includes a paddle apparatus. The paddle apparatus includes a paddle base having a first side and a second side. The second side is configured to be partially disposed within and pivotally coupled to a housing of an electrical wiring device. The paddle apparatus also includes a metal member coupled to the paddle base and disposed substantially along the first side of the paddle.

Another exemplary embodiment of the present invention includes a method of manufacture. The method includes forming a switch assembly, which further includes disposing a metal member onto a switch, the metal member comprising a first coupling mechanism and the switch comprising a second coupling mechanism, and securely coupling the first coupling mechanism to the second coupling mechanism.

Another exemplary embodiment of the present invention includes an electrical wiring device. The electrical wiring device includes a housing having an opening formed therein, a toggle partially disposed within the opening. The toggle includes a base portion and an interface portion. The base portion of the toggle is coupled to one or more components within the housing and the interface portion extends outwardly from the base portion and is substantially external to the housing. The electrical wiring device further includes a metal member disposed over at least a portion of the toggle.

BRIEF DESCRIPTION OF THE DRAWINGS

The foregoing and other features and aspects of the invention are best understood with reference to the following description of certain exemplary embodiments, when read in conjunction with the accompanying drawings, wherein.

BRIEF DESCRIPTION OF EXEMPLARY EMBODIMENTS

Figure 1:
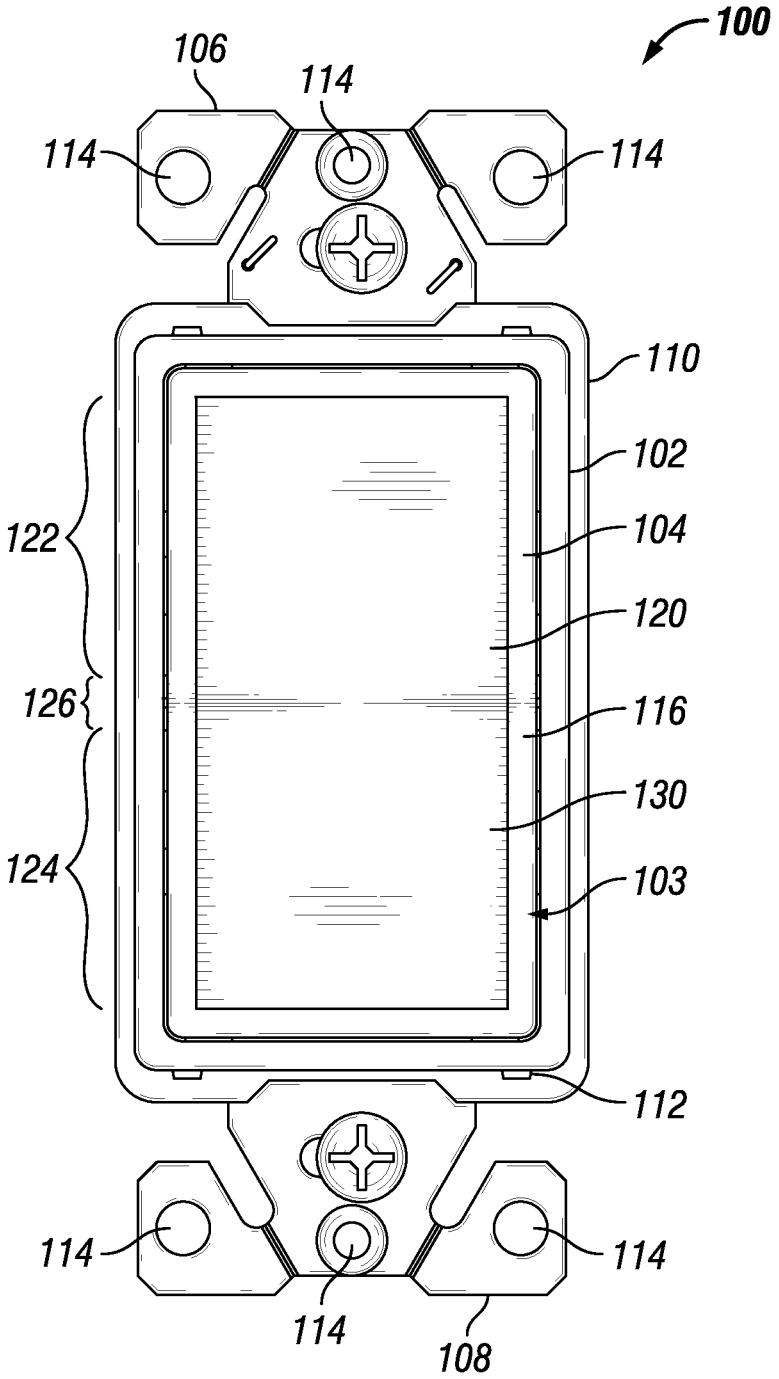
FIG. 1 is a frontal view of a wiring device having a paddle switch, in accordance with an exemplary embodiment of the present invention.

The present invention is directed to wiring devices, such as switches, having a metal switch cover. Although the description of exemplary embodiments is provided below in conjunction with paddle-style and toggle-style switches, alternate exemplary embodiments of the invention are applicable to other types of electrical wiring devices having a user contact surface including, but not limited to, receptacles, switches, and any other electrical wiring device known to people having ordinary skill in the art. The exemplary embodiments of the invention are better understood by reading the following description of non-limiting, exemplary embodiments with reference to the attached drawings, wherein like parts of each of the figures are identified by like reference characters, and which are briefly described as follows.

FIG. 1 is a frontal view of a wiring device 100 having a paddle switch in accordance with an exemplary embodiment of the present invention. With reference to FIG. 1, the wiring device 100 is substantially rectangularly shaped and includes a housing 102, a paddle switch assembly 103, an upper coupling band 106, and a lower coupling band 108.

The upper coupling band 106 and the lower coupling band 108 are generally formed separately from one another and are both partially disposed within the housing 102. However, in other exemplary embodiments, the upper coupling band 106 and the lower coupling band 108 are formed as a single component. The upper coupling band 106 generally extends beyond an upper end 110 of the housing 102 and the lower coupling band 108 generally extends beyond a lower end 112 of the housing 102. Each of the upper coupling band 106 and the lower coupling band 108 includes one or more apertures 114. In certain exemplary embodiments, these apertures 114 are used to couple the wiring device 100 to a wall box (not shown) using a screw (not shown) or other fastening device known to people having ordinary skill in the art. The upper coupling band 106 and the lower coupling band 108 are generally fabricated using a metal, such as steel, but are capable of being fabricated using other materials known to people having ordinary skill in the art.

The housing 102 is coupled to at least one of the upper coupling band 106 and the lower coupling band 108. The housing 102 is substantially rectangularly shaped but it is capable of being formed in other geometric or non-geometric shapes. In certain exemplary embodiments, the housing 102 includes electrical components (not shown), including electrical contacts, for electrically coupling the wiring device 100 to building wires (not shown) and to load wires (not shown) that are electrically coupled to an associated load (not shown).

Figure 3:
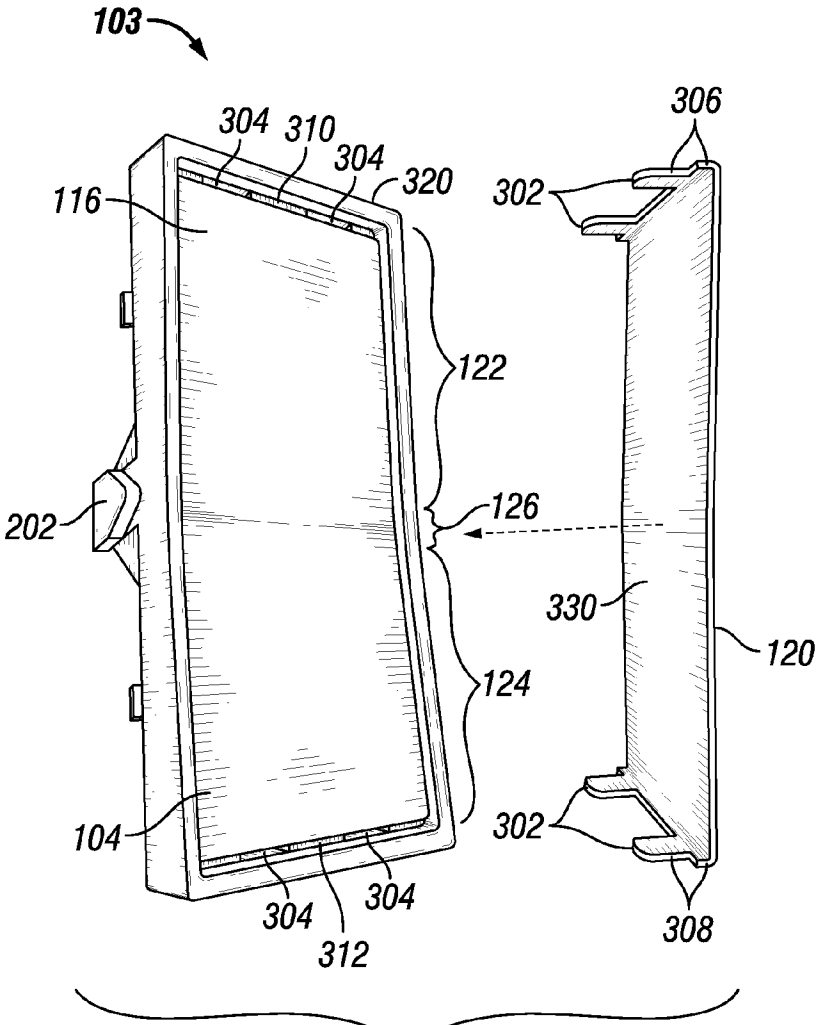
FIG. 3 is an exploded view of the paddle switch assembly of FIG. 2, in accordance with an exemplary embodiment of the present invention.

The paddle switch assembly 103 includes a paddle 104 and a metal switch cover 120. The metal switch cover 120 is disposed on a front side 116 of the paddle 104. The metal switch cover 120 includes a first side 130 and a second side 330 (FIG. 3). The second side 330 (FIG. 3) of the metal switch cover 120 is coupled to the front side 116 of the paddle 104 when the metal switch cover 120 is disposed onto the paddle 104, and the first side 130 is exposed and accessible to a user. In certain exemplary embodiments, the metal switch cover 120 has a similar shape as the front side 116 of the paddle 104 and covers almost the entire surface of the front side 116 of the paddle 104. According to certain exemplary embodiments, the paddle switch assembly 103 is at least partially disposed in the housing 102, in which the front side 116 of the paddle 104 and the metal switch cover 120 remain external to the housing 102 and face away from the housing 102. However, in other exemplary embodiments, greater or fewer components of the paddle switch assembly 103 are disposed within the housing 102. In certain exemplary embodiments, the paddle 104 has a rectangular shape from a frontal view similar to that of the housing 102. The paddle 104 also includes a back side 418 (FIG. 4) opposite the front side 116, which is disposed in and coupled to the housing 102. In certain exemplary embodiments, the metal switch cover 120 has the same profile as the front side 116 of the paddle 104. For example, if the front side 116 of the paddle 104 is flat, then the metal switch cover 120 is correspondingly flat as well. Likewise, if the front side 116 of the paddle 104 has a curvature or angle, the metal switch cover 120 generally has a similar corresponding curvature or angle shape.

In some exemplary embodiments, the paddle 104 includes a first portion 122, a second portion 124, and a middle portion 126 adjacent to both the first portion 122 and the second portion 124 and disposed therebetween. Generally, the middle portion 126 functions as a pivot, allowing the first portion 122 and the second portion 124 to rock back and forth about the pivot, or middle portion 126. In certain exemplary embodiments, the first portion 122 and the second portion 124 are positioned to form an obtuse angle therebetween. Thus, in such exemplary embodiments, the middle portion 126 facilitates the formation of such an angle. According to some exemplary embodiments, the middle portion 126 is substantially planar or also is formed at an angle. The paddle 104 is generally disposed in the housing 102 such that the middle portion 126 is pivotally coupled to the housing 102 via the back side 418 (FIG. 4) of the paddle 104. Thus, the first and second portions 122, 124 are able to rock back and forth in the housing 102 about the pivot, or middle portion 126. For example, when the first portion 122 is depressed towards the housing 102, the second portion 124 moves outwardly from the housing 102. Likewise, when the second portion 124 is depressed towards the housing 102, the first portion 122 moves outwardly from the housing 102. Generally, when one of the first or second portion 122, 124 of the paddle 104 is depressed, one or more electrical contacts in the housing 102 are electrically coupled to complete an electrical circuit, which allows current to flow to a load. This may, for example, turn the load on or change a state of operation of the load. Conversely, when the other of the first or second portion 122, 124 is depressed, one or more electrical contacts in the housing 102 may be decoupled, thereby turning the load off or changing a state of operation of the load. In certain exemplary embodiments, the first and second portions 122, 124 may be flat, curved, or angled with respect to each other. As discusses above, the metal switch cover 120 generally follows the profile of the paddle 104. However, in other exemplary embodiments, the metal switch cover 120 does not generally follow the profile of the paddle 104. Thus, the metal switch cover 120 also may be flat, curved, or angled according to the paddle 104.

Generally, either the first portion 122 or second portion 124 of the paddle 104 is depressed by a user. The metal switch cover 120 disposed on the paddle 104 generally serves as a contact point between the user and the paddle 104. As such, the metal switch cover 120 is fabricated from a material having antimicrobial properties. Thus, some microorganisms that are transferred to the metal switch cover 120 through user contact is killed, potentially reducing or eliminating the amount of microorganisms passed on to the next user. Additionally, according to some exemplary embodiments, the metal switch cover 120 is easier to clean than the paddle 104 itself. In certain exemplary embodiments, the metal switch cover 120 is fabricated from materials including at least one of, but not limited to, copper, nickel, silver, gold, stainless steel, plated steel, a combination thereof, and so forth. In certain exemplary embodiments, the material includes a copper-nickel alloy. Additionally, in certain embodiments, the metal switch cover 120 is fabricated from a similar or different material, but includes a layer, such as a coating, of an antimicrobial material such as those described above and more.

Figure 2:
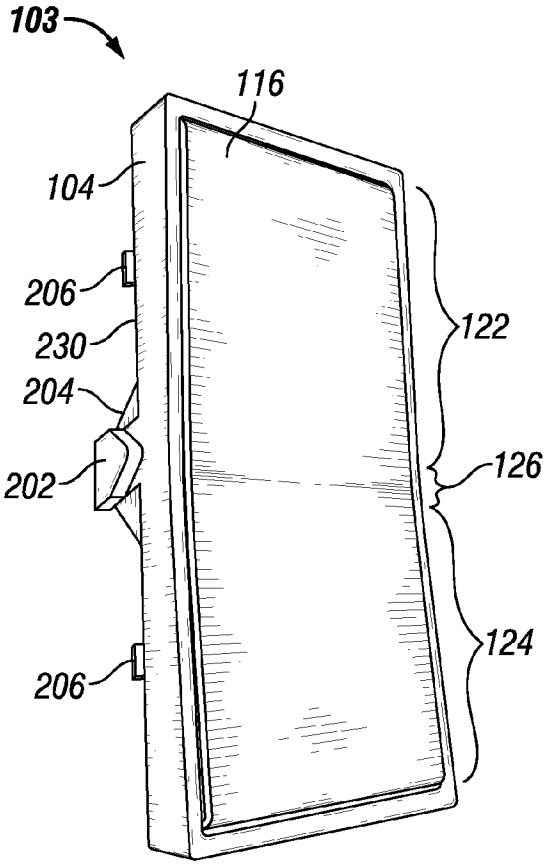
FIG. 2 is a perspective view of a paddle switch assembly of the wiring device of FIG. 1, in accordance with an exemplary embodiment of the present invention.

FIG. 2 is a perspective view of the paddle switch assembly 103 decoupled from the housing 102, in accordance with exemplary embodiments of this disclosure. According to certain exemplary embodiments, the first portion 122 and the second portion 124 of the paddle 104 join at an obtuse angle at the middle portion 126, forming a pivot 202 in the paddle 104. Thus, the paddle 104 is able to rock back and forth about the pivot 202 when coupled to the housing 102 (FIG. 1). In this exemplary embodiment, the metal switch cover 120 includes a similar obtuse angle as the paddle 104 such that its profile follows the profile of the paddle 104. The metal switch cover 120 covers nearly the entire front side 116 of the paddle 104. However, in some exemplary embodiments, the metal switch cover 120 includes two or more separate components rather than one continuous component. For example, in one such exemplary embodiment (not shown), one of these components is disposed as the first portion 122 of the paddle 104 and a separate component is disposed as the second portion 124 of the paddle 104. According to certain exemplary embodiments, the two components may not be coupled to each other and/or may not cover the entire surface of the paddle. In certain exemplary embodiments, the metal switch cover 120 is flat and rectangular as illustrated. However, in certain exemplary embodiments, the metal switch cover 120 is fabricated in a different configuration, such as bulbous, ridged, concave, round, etc.

The paddle 104 further includes a pair of spring tabs 204 disposed on two opposite sides 230 of the paddle 104. The spring tabs 204 allow the paddle 104 to be inserted and partially held coupled to the housing 102 (FIG. 1) while allowing the paddle 104 to rock back and forth within the housing 102 (FIG. 1). The spring tabs 204 are generally located on either side of the paddle 104 at the middle portion 126, or pivot 202. In certain exemplary embodiments, the paddle 104 also includes a plurality of tabs 206 on at least one side 230 of the first portion 122 of the paddle 104 and one side 230 of the second portion 124 of the paddle 104. The tabs 206 engage with corresponding elements in the housing 102 to facilitate paddle 104 positioning and/or stability when a respective portion of the paddle 104 is depressed.

FIG. 3 is an exploded view of the paddle 104, in which the metal switch cover 120 is disengaged from the paddle 104. In certain exemplary embodiments, the metal switch cover 120 includes a plurality of protrusions 302, such as tabs, extending from, for example, two edges 306, 308 of the metal switch cover 120. The protrusions 302 typically extend from the second side 330 of the metal switch cover 120 at substantially right angles. Correspondingly, the paddle 104 includes a plurality of openings 304, such as slots, at corresponding positions configured to receive the protrusions 302. For example, FIG. 3 illustrates an exemplary embodiment in which the metal switch cover 120 includes four tabs (protrusions 302), with two tabs extending from a first edge 306 at substantially right angles and two tabs extending from a second edge 308, opposite of the first edge 306, at substantially right angles. Likewise, the paddle 104 includes four slots (openings 304), with two slots located at a first edge 310 of the paddle 104 and two slots located at a second edge 312, opposite the first edge 310, of the paddle 104. The tabs (protrusions 302) of the metal switch cover 120 are configured to be disposed through the corresponding slots (openings 304) of the paddle 104, coupling the metal switch cover 120 to the front side 116 of the paddle 104. In certain exemplary embodiments, and as illustrated in FIG. 3, the paddle 104 includes a perimeter 320 which outlines the front side 116 of the paddle 104 and which is raised and protruding outwardly from the front side 116. Thus, the perimeter 320 is generally raised in relation to the general surface of the front side 116. In certain embodiments, the metal switch cover 120 is disposed on the front side 116 of the paddle 104 within this raised perimeter 320.

Figure 4:
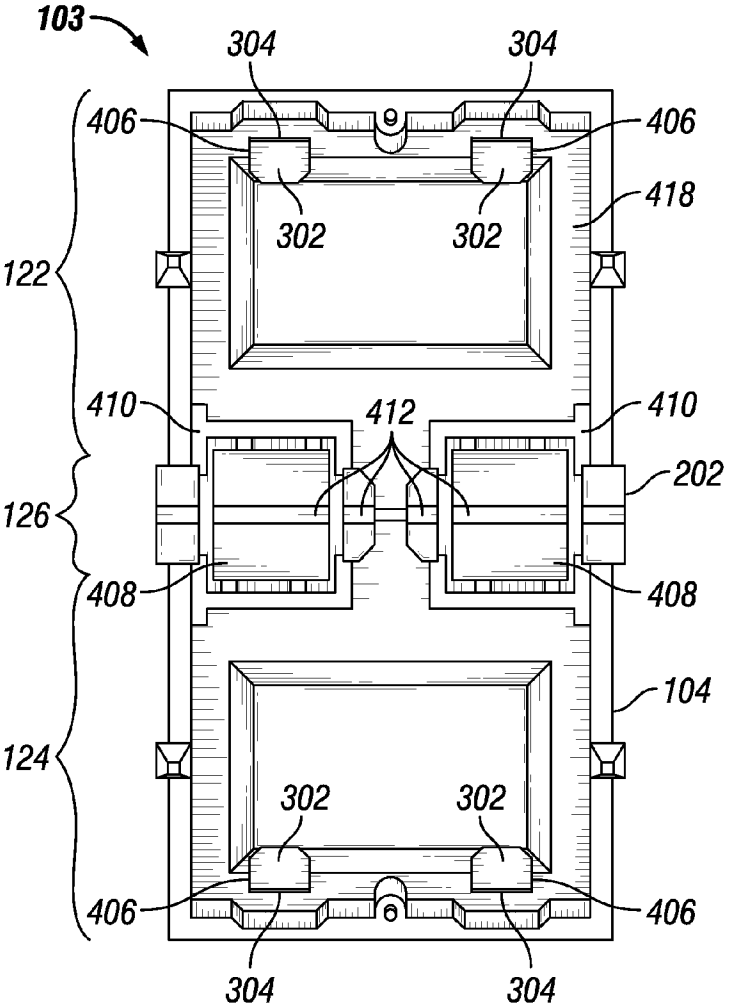
FIG. 4 is a rear view of the paddle assembly of FIG. 2, in accordance with an exemplary embodiment of the present invention.

FIG. 4 illustrates the back side 418 of the paddle 104 in which the metal switch cover 120 (FIG. 3) is disposed onto the front side 116 (FIG. 3) of the paddle 104, in accordance with exemplary embodiments of the present disclosure. The tabs 302 of the metal switch cover 120 (FIG. 3) are shown to be disposed through the slots 304, or openings, in the paddle 104 as disclosed above. Additionally, the tabs 302 are bent around a respective edge 406 of each of the slots 304, which define at least a portion of that respective slot 304, such that portions of the paddle 104 are disposed between the tabs 302 and the second side 330 (FIG. 3) of the metal switch cover 120 (FIG. 3). Thus, the metal switch cover 120 (FIG. 3) is generally secured onto the paddle 104. In certain exemplary embodiments, the protrusions 302 of the metal switch cover 120 (FIG. 3) and the openings 304 of the paddle 104 are respectively positioned in corresponding configurations other than as shown in the illustrated exemplary embodiment. In certain exemplary embodiments, the tabs 302 of the metal switch cover 120 (FIG. 3) are configured to wrap around the outside perimeter 320 (FIG. 3) of the paddle 104 rather than around the edge 406 that defines a portion of the slots 304 in the paddle 104. In certain exemplary embodiments, the metal switch cover 120 (FIG. 3) includes one or more walls (not shown) extending from the second side 330 (FIG. 3) of the metal switch cover 120 (FIG. 3). These walls are configured to at least partially encase the paddle 104 such that user accessible portions of the paddle switch assembly 103 are generally covered by the metal switch cover 104. In such exemplary embodiments, the entire front side 116 (FIG. 1) of the paddle 104 is covered by the metal switch cover 120 (FIG. 3). Additionally, in some exemplary embodiments, the metal switch cover 120 (FIG. 3) is coupled onto the paddle 104 by other means of attachment. For example, the metal switch cover 120 (FIG. 3) may be disposed onto the paddle 104 via adhesives, hooks, snaps, Velcro, magnets, sliders, or various other mechanical and non-mechanical means. Generally, the paddle switch assembly 103 is assembled by joining the metal switch cover 120 to the paddle 104 and coupling the respective coupling mechanisms, such as protrusions 302 and openings 304, thereby securing the metal switch cover 120 (FIG. 3) onto the paddle 104. For example, the paddle switch assembly 103 illustrated in FIGS. 2 and 4 is assembled by coupling the metal switch cover 120 (FIG. 3) to the paddle 104, inserting the tabs (protrusions 302) of the metal switch cover 120 (FIG. 3) into the slots (openings 304) of the paddle 104, and bending the tabs (protrusions 302) around one edge 406 that defines a portion of the respective slot (opening 304). The metal switch cover 120 (FIG. 3) is thereby secured onto the paddle 104.

Still referring to FIG. 4, the backside 418 of the paddle 104 further includes one or more rocking elements 408 disposed in respective receptacles 410 attached to the backside 418 of the paddle 104 at the middle portion 126 or pivot 202. The rocking elements 408 facilitate the rocking motion of the paddle 104 about the pivot 202 inside the housing 102. In the illustrated exemplary embodiment, the rocking elements 408 and portions of the receptacles 410 have grooves 412 formed therein to engage with a corresponding rod 502 (FIG. 5) disposed within and coupled to the housing 102. Although the rocking elements 408 are used in certain exemplary embodiments to facilitate the rocking motion of the paddle 104, the rocking elements 408 are embodied in various alternative forms in other exemplary embodiments. Further, in certain exemplary embodiments, the rocking elements 408 are optional. In such exemplary embodiments, the function performed by the rocking elements 408 is carried out by the paddle 104 itself through a certain paddle configuration or through other means known to one having ordinary skill in the art.

Figure 5:
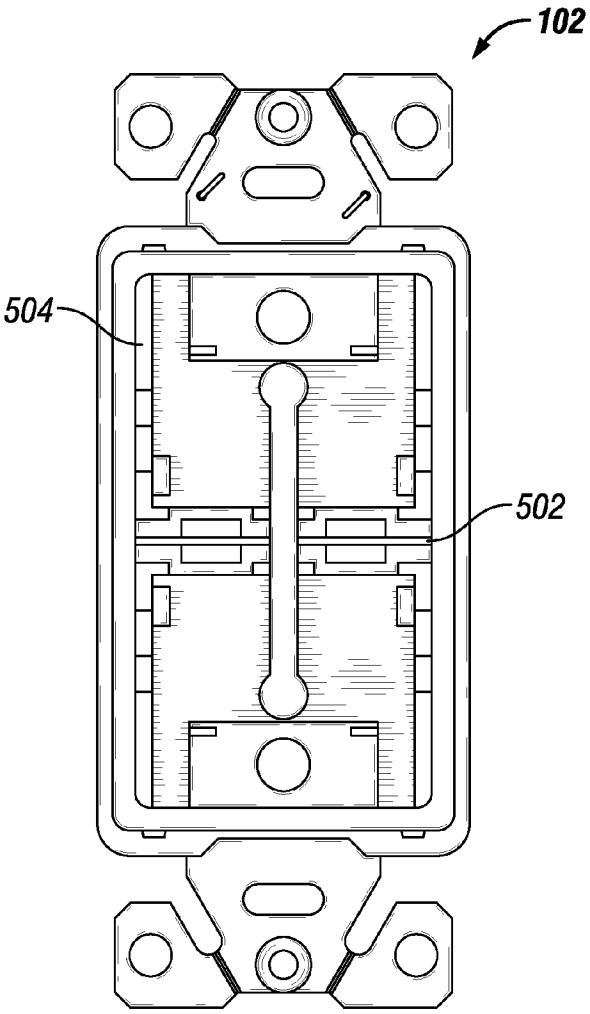
FIG. 5 is a frontal view of a housing of the wiring device of FIG. 1 with the paddle switch assembly removed, in accordance with an exemplary embodiment of the present invention.

FIG. 5 is a frontal view of the housing 102 with the paddle 104 (FIG. 4) removed, in accordance with exemplary embodiments of the present disclosure. The housing 102 includes a recessed portion 504 configured to receive and house portions of the paddle 104 (FIG. 4). In the illustrated exemplary embodiment, the housing 102 includes an exposed rod 502 disposed across a width of the recessed portion 504. The rod 502 is configured to engage with the grooves 412

(FIG. 4) in the rocking elements 408 (FIG. 4) and receptacles 410 (FIG. 4) of the paddle 104 (FIG. 4), as discussed above. The recessed portion 504 of the housing 102 has a similar shape and dimension as the paddle 104 (FIG. 4), such that the paddle 104 (FIG. 4) is intimately disposed within and coupled to the recessed portion 504 via the backside 418 (FIG. 4) of the paddle 104 (FIG. 4) and while leaving the paddle's front side 116 (FIG. 1) exposed. When the rocking elements 408 (FIG. 4) are coupled to the housing 102 via the grooves 412 (FIG. 4) and rod 502, the paddle 104 (FIG. 4) is able to rock back and forth inside the housing 102 about the rod 502. Rocking back and forth refers to the depression of the first portion 122 (FIG. 4) and/or depression of the second portion 124 (FIG. 4) of the paddle 104 (FIG. 4), which turns an associated load on and off, for example.

The paddle switch 100 illustrated in FIGS. 1-5 is an exemplary embodiment of a wiring device having a metal switch cover 120, in which the metal switch cover 120 includes antimicrobial properties capable of reducing the number of microorganisms living on its surface. Thus, such wiring devices are able to reduce the number of microbes that are passed from one user to the next when operating the wiring device.

Figure 6:
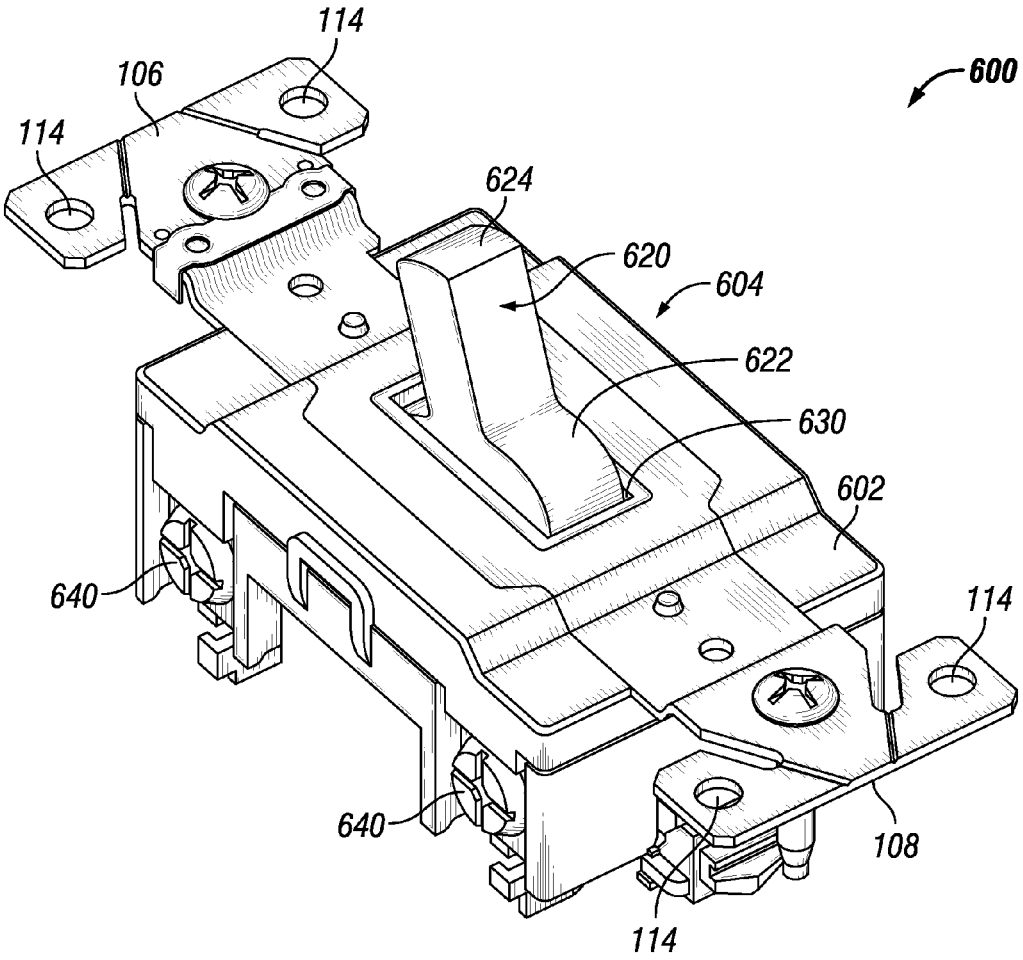
FIG. 6 is a perspective view of a wiring device having a toggle switch, in accordance with another exemplary embodiment of the present invention.

FIG. 6 is a perspective view of a wiring device 600 having a toggle switch in accordance with an exemplary embodiment of the present disclosure. Referring to FIG. 6, the wiring device 600 having a toggle switch includes a housing 604, the upper coupling band 106, the lower coupling band 108, and the apertures 114 in the upper and lower coupling bands 106, 108. The wiring device 600 also includes a toggle switch assembly 620 disposed therein for controlling an associated load (not shown). In certain exemplary embodiments, the housing 604 includes electrical components (not shown), including electrical contacts such as screws 640, for electrically coupling the wiring device 600 to building wires (not shown) and to load wires (not shown) that are electrically coupled to the associated load (not shown). The housing 604 is substantially and functionally similar to housing 102 (FIG. 1) of wiring device 100 (FIG. 1) with paddle switch assembly 103 (FIG. 1). However, in the present exemplary embodiment, the housing 604 includes a top surface 602. The top surface 602 of the housing 604 includes an opening 630 generally formed centrally within the top surface 602. The opening 630 is generally rectangularly shaped and configured to have the toggle switch assembly 620 extend partially therethrough. Accordingly, the toggle switch assembly 620 is partially disposed through the opening 630 such that the toggle switch assembly 620 is coupled to certain mechanical and/or electrical components inside the housing 604 and is also accessible externally of the housing 604. Specifically, the toggle switch assembly 620 includes a base portion 622 and an interfacing portion 624. The base portion 622 is partially disposed through the opening 630 and pivotally coupled to certain components inside the housing 604 while the interfacing portion 624 remains external to the housing 604 such that the interfacing portion 624 is accessible by an end user to operate the wiring device 600. The toggle switch assembly 620 is positionable into two or more positions, thereby putting the associated load into respective states.

Figure 7:
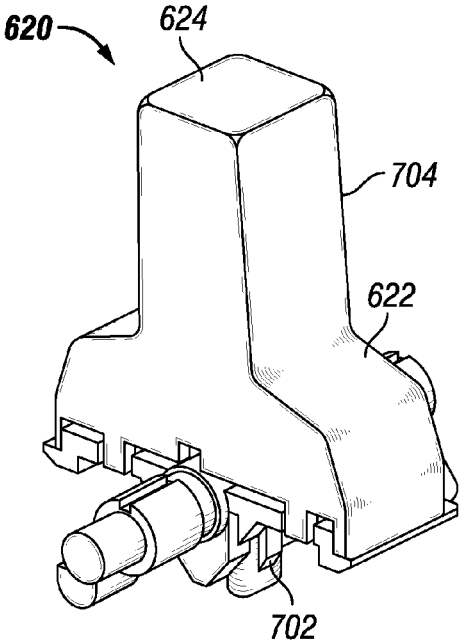
FIG. 7 is a perspective view of a toggle switch assembly of the wiring device of FIG. 6, in accordance with an exemplary embodiment of the present invention.
Figure 8:
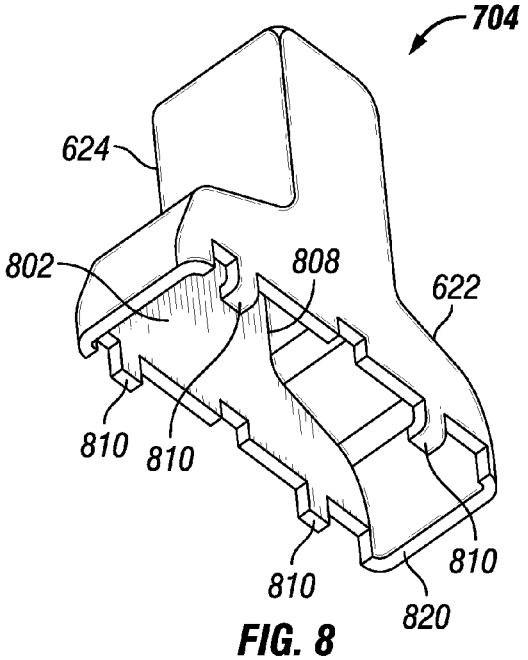
FIG. 8 is a perspective view of a metal switch cover of the toggle switch assembly of FIG. 7, in accordance with an exemplary embodiment of the present invention.

FIG. 7 is a perspective view of the toggle switch assembly 620 of FIG. 6 in accordance with certain exemplary embodiments. Referring to FIG. 7, the toggle switch assembly 620 includes a toggle 702 and a metal switch cover 704. The metal switch cover 704 is disposed over at least a portion of the toggle 702. The metal switch cover 704 is further illustrated in FIG. 8, and the toggle 702 is further illustrated in FIG. 9. Referring to FIG. 8, the metal switch cover 704 includes the interfacing portion 624 and the base portion 622. The base portion 622 is generally rectangularly shaped. The interfacing portion 624 is also generally rectangularly shaped and extends orthogonally from an approximate midpoint of the base portion 622 according to certain exemplary embodiments. The metal switch cover 704 includes a cavity 808 formed within the base portion 622 and optionally within the interfacing portion 624 such that the metal switch cover 704 is essentially a toggle-shaped shell with an open bottom 802. The metal switch cover 704 generally serves as the main contact point between the user and the wiring device 600 (FIG. 6).

The metal switch cover 704 is fabricated from a material having antimicrobial properties. Thus, at least some microorganisms that are transferred to the metal switch cover 704 through user contact is killed, potentially reducing or eliminating the amount of microorganisms passed on to the next user. The metal switch cover 704 is fabricated from a material that is selected from at least one of, but not limited to, copper, nickel, silver, gold, stainless steel, plated steel, a combination thereof, and so forth. In certain exemplary embodiments, the metal switch cover 704 is fabricated from a copper-nickel alloy. Additionally, in certain exemplary embodiments, the metal switch cover 704 is fabricated from any material but also includes a layer, such as a coating, of an antimicrobial material such as those described above and more.

Figure 9:
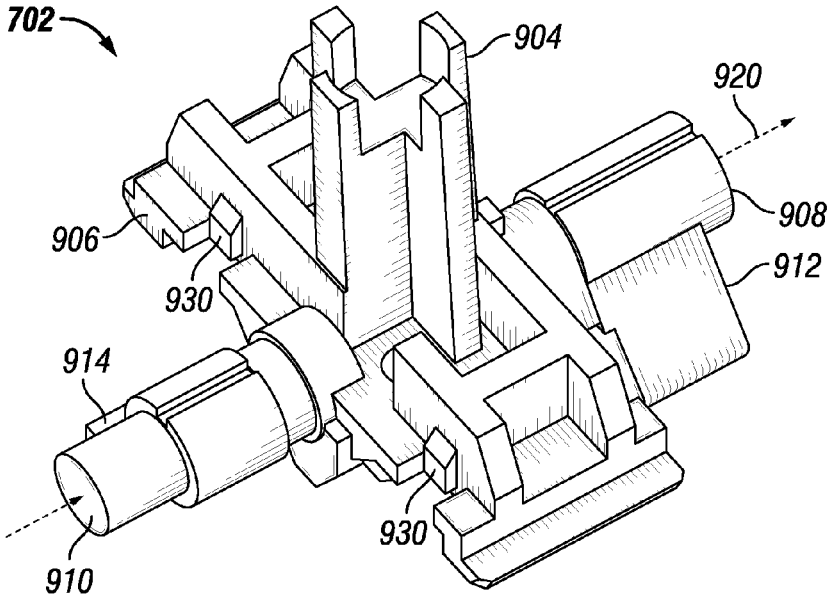
FIG. 9 is a perspective view of a toggle of the toggle switch assembly of FIG. 7, in accordance with an exemplary embodiment of the present invention.

Referring to FIG. 9, the toggle 702 includes a toggle stem 904, a toggle base 906, a first roller 908, and a second roller 910. The toggle stem 904 extends generally orthogonally from the toggle base 906. The first and second rollers 908, 910 extend in opposing directions from the toggle base 906, and perpendicularly to the toggle base 906 and toggle stem 904. The first and second rollers 908, 910 include respective first and second flippers 912, 914 coupled to and extending from the respective roller 908, 910. The toggle stem 904 is configured to be disposed within the interfacing portion 624 (FIG. 8) of the metal switch cover 704 (FIG. 8) via the cavity 808 (FIG. 8). Accordingly, the toggle base 906 is configured to be disposed within the base portion 622 (FIG. 8) of the metal switch cover 704 (FIG. 8) via the cavity 808 (FIG. 8). Thus, the toggle 702 moves in the same manner as the metal switch cover 704 (FIG. 8) as the toggle switch assembly 620 (FIG. 7) is put into a certain position by the user. When the metal switch cover 704 (FIG. 8) is fully disposed over the toggle 702, the bottom 802 (FIG. 8) of the metal switch cover 704 (FIG. 8) is coupled to the toggle base 906 via one or more coupling mechanisms 810 (FIG. 8) on the metal switch cover 704 (FIG. 8) and corresponding coupling mechanisms 930 on the toggle base 906. In certain exemplary embodiments, as illustrated in FIGS. 7-9, the metal switch cover 704 includes a one or more tabs and/or hooks 810. Correspondingly, the toggle base 906 includes one or more ledges 930, or protrusions, for biasing the tabs and/or hooks, thereby holding the metal switch cover 704 against the toggle 702. In certain embodiments, the coupling mechanisms 930 may be snaps, clips, hooks, pins, adhesives, or the like. Generally, the toggle 702 is positionable into two or more positions about a central axis 920 of the first and second rollers 908, 910. Accordingly, when the toggle switch assembly 620 is put into a first position, the first and second rollers 908, 910 rotate counterclockwise about the central axis 920. The second flipper 914 also moves counterclockwise and eventually biases and actuates a mechanism which puts the load into a first state. Likewise, when the toggle switch assembly 620 is put into a second position, the first and second rollers 908, 910 rotate clockwise about the central axis 920, and the first flipper 912 moves to bias and actuate a mechanism which puts the load into a second state.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. An electrical wiring device, comprising:

a housing forming a cavity therein, wherein the housing comprises a first rod and a second rod disposed within the cavity of the housing, each rod extending partially along a width of the cavity;

a paddle assembly disposed at least partially within the cavity, the paddle assembly comprising:

a paddle base comprising a first side and a second side opposite to the first side, wherein the second side faces the cavity and is disposed within the cavity, wherein the second side comprises:

one or more rocking elements disposed in respective receptacles attached to the second side at substantially a middle portion of the paddle base; and an elongated groove formed in each rocking element and a portion of its respective receptacle and configured to engage with at least one of the first rod and the second rod in the housing to pivotally couple the paddle base to the housing; and a metal cover member coupled to the paddle base and disposed substantially on the first side of the paddle base, wherein the paddle assembly is pivotally movable between a first position and a second position.

2. The electrical wiring device of claim 1, wherein the first side of the paddle base comprises a wall extending orthogonally away from the first side about the perimeter of the first side, the wall defining a cavity that receives at least a portion of the metal cover member therein.

3. The electrical device of claim 1, wherein the metal cover member comprises a first side and a second side, the second side comprising one or more walls extending from one or more edges, at least a portion of the walls encasing at least a portion of the paddle base when the metal cover member is disposed onto the first side of the paddle base.

4. The electrical wiring system of claim 1, wherein the paddle assembly comprises an obtuse angle, wherein the vertex of the obtuse angle defines a pivot about which the paddle assembly is pivotally movable between the first position and the second position.

5. The electrical wiring system of claim 1, wherein the metal cover member is disposed over approximately the entire first side of the paddle base.

6. The electrical wiring system of claim 1, wherein the metal cover member is fabricated using an antimicrobial material.

7. The electrical wiring system of claim 6, wherein the antimicrobial material is selected from a group consisting of at least one of copper, silver, stainless steel, plated steel, and gold.

8. A paddle apparatus, comprising:

a paddle base comprising a front surface and a back surface, wherein the front surface comprises a first portion, a second portion, and a middle portion disposed between the first portion and the second portion, a first side extending substantially orthogonally away from a first longitudinal edge of the front surface to a first longitudinal edge of the back surface, a second side opposite to the first side and extending substantially orthogonally away from a second longitudinal edge of the front surface to a second longitudinal edge of the back surface; and a pair of spring tabs comprising a first spring tab disposed on the first side and a second spring tab disposed on the second side of the paddle base substantially at a middle portion of the first side and the second side, wherein the back surface is configured to be disposed within and coupled to a housing of an electrical wiring device; and a first metal cover member coupled to and disposed over the first portion of the front surface of the paddle base; and a second metal cover member coupled to and disposed over the second portion of the front surface of the paddle base.

9. The paddle apparatus of claim 8, wherein the paddle base comprises a first coupling mechanism and each metal cover member comprises a second coupling mechanism, wherein the first coupling mechanism is securely coupled to the second coupling mechanism.

10. The paddle apparatus of claim 9, wherein the first coupling mechanism comprises a plurality of slots and the second coupling mechanism comprises a plurality of tabs, wherein the plurality of tabs disposed through the plurality of slots to couple the paddle base to the each metal cover member.

11. The paddle apparatus of claim 8, wherein each of the metal cover members is selected from a group consisting of at least one of copper, silver, stainless steel, plated steel, and gold.

12. The switching apparatus of claim 8, wherein each of the metal cover members is fabricated using an antimicrobial material.

13. The switching apparatus of claim 8, wherein the front surface of the paddle base comprises a first profile, the first metal cover member comprises a second profile substantially matching the first portion of the paddle base, and the second metal cover member comprises a third profile that substantially matches the second portion of the paddle base.

* * * * *